US009580893B2

(12) United States Patent
Blum et al.

(10) Patent No.: US 9,580,893 B2
(45) **Date of Patent: *Feb. 28, 2017**

(54) SANITARY INSTALLATION PART

(71) Applicant: Neoperl GmbH, Mullheim (DE)

(72) Inventors: Gerhard Blum, Gutach (DE); Hermann Grether, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/181,134

(22) Filed: Jun. 13, 2016

(65) Prior Publication Data

US 2016/0281340 A1 Sep. 29, 2016

Related U.S. Application Data

(63) Continuation of application No. 14/169,670, filed on Jan. 31, 2014, now Pat. No. 9,388,557, which is a (Continued)

(51) Int. Cl.
*E03C 1/08* (2006.01)
*E03C 1/084* (2006.01)

(Continued)

(52) U.S. Cl.
CPC ..... *E03C 1/084* (2013.01); *B05B 1/00* (2013.01); *B05B 1/02* (2013.01); *B05B 1/14* (2013.01);

(Continued)

(58) Field of Classification Search
CPC ..... B05B 7/0425; B05B 1/14; B05B 1/3026; B05B 7/1209; B05B 1/00; B05B 1/34;

(Continued)

(56) References Cited

U.S. PATENT DOCUMENTS 3,014,667 A 12/1961 McLean et al.
3,424,387 A 1/1969 Aghnides (Continued)

FOREIGN PATENT DOCUMENTS

CH 380042 8/1964
DE 9314990.5 1/1994

(Continued)

*Primary Examiner* — Steven J Ganey
(74) *Attorney, Agent, or Firm* — Volpe and Koenig, P.C.

(57) ABSTRACT

A sanitary fixture is provided having an upstream end and a downstream end, the sanitary fixture includes a mounting housing having a thread which is matingly engagable with a thread provided on a water outlet of a sanitary outlet fitting. The mounting housing has a downstream housing end side with flow-through holes. At least one insertion part can be inserted into the mounting housing as far as an insertion stop. The fixture includes an aerated jet regulator which is configured such that a circumferential wall of the mounting housing includes at least one aeration duct at least in a subregion of at least a double-walled configuration. The at least one aeration duct, which is arranged towards the downstream housing end side, opens out in at least one aeration opening leading into a housing interior of the mounting housing.

18 Claims, 14 Drawing Sheets

Related U.S. Application Data continuation of application No. 13/304,774, filed on Nov. 28, 2011, now Pat. No. 8,708,252.

(51) Int. Cl.

| | |
|---|---|
| ***B05B 1/00*** | (2006.01) |
| ***B05B 1/02*** | (2006.01) |
| ***B05B 1/14*** | (2006.01) |
| ***B05B 1/30*** | (2006.01) |
| ***B05B 1/34*** | (2006.01) |
| ***B05B 7/04*** | (2006.01) |
| ***B05B 7/12*** | (2006.01) |
| ***B05B 15/06*** | (2006.01) |
| ***E03C 1/086*** | (2006.01) |

(52) U.S. Cl.

CPC ..... *B05B 1/3026* (2013.01); *B05B 1/34* (2013.01); *B05B 7/0425* (2013.01); *B05B 7/1209* (2013.01); *B05B 15/065* (2013.01); *E03C 1/086* (2013.01); *Y10S 239/23* (2013.01)

(58) Field of Classification Search

CPC ..... B05B 1/02; B05B 15/065; E03C 1/084; E03C 1/086; Y10S 239/23

USPC .... 239/419.5, 428.5, 553–553.5, 590–590.5, 239/600, DIG. 23, 580

See application file for complete search history.

(56) References Cited

U.S. PATENT DOCUMENTS

| | | | | |
|---|---|---|---|---|
| 3,827,636 | A | | 8/1974 | Parkison et al. |
| 4,534,513 | A | | 8/1985 | Aghnides |
| 4,534,514 | A | | 8/1985 | Aghnides |
| 4,637,552 | A | | 1/1987 | Finkbeiner et al. |
| 4,789,103 | A | | 12/1988 | Ruhnke |
| 6,126,093 | A | * | 10/2000 | Grether ..... E03C 1/084 239/428.5 |
| 6,892,964 | B2 | | 5/2005 | Grether et al. |
| 6,902,123 | B2 | | 6/2005 | Grether et al. |
| 7,677,473 | B2 | | 3/2010 | Kao |
| 2002/0084353 | A1 | | 7/2002 | Griffin et al. |
| 2007/0196177 | A1 | | 8/2007 | Tasi |
| 2008/0111007 | A1 | | 5/2008 | Grether |
| 2009/0008478 | A1 | | 1/2009 | Grether |
| 2010/0065661 | A1 | | 3/2010 | Grether et al. |
| 2011/0303309 | A1 | | 12/2011 | Prenzler |

FOREIGN PATENT DOCUMENTS

| | | | |
|---|---|---|---|
| DE | 102005010551 | A1 | 5/2007 |
| DE | 202008010725 | U1 | 12/2009 |
| DE | 102008050247 | A1 | 3/2010 |
| DE | 202010014392 | U1 | 1/2012 |
| DE | 202010014393 | U1 | 1/2012 |
| DE | 102010048701 | A1 | 3/2012 |
| DE | 102010048702 | A1 | 3/2012 |
| EP | 0216319 | A2 | 4/1987 |
| EP | 001251946 | | 12/2010 |
| EP | 001282065 | | 6/2011 |
| EP | 001259961 | | 8/2011 |
| WO | 2006092316 | A2 | 9/2006 |
| WO | 2006094680 | A1 | 9/2006 |
| WO | 2006122579 | A1 | 11/2006 |
| WO | 2010017855 | A1 | 2/2010 |

* cited by examiner

SANITARY INSTALLATION PART

INCORPORATION BY REFERENCE

The following documents are incorporated herein by reference as if fully set forth: U.S. patent application Ser. No. 14/169,670, filed Jan. 31, 2014, a continuation of U.S. patent application Ser. No. 13/304,774, filed Nov. 28, 2011, and issued as U.S. Pat. No. 8,708,252 on Apr. 29, 2014.

BACKGROUND

The invention relates to a sanitary fixture with a single- or multi-part mounting housing which has a thread for fastening to a mating thread provided on the water outlet of a sanitary outlet fitting, wherein the mounting housing has a downstream housing end side with flow-through holes, and wherein at least one insertion part can be inserted into the mounting housing as far as an insertion stop.

Sanitary fixtures are required in a very wide variety of embodiments as jet formers, unaerated jet regulators, jet aerators, flow-through quantity regulators or backflow preventers. For example, aerated jet regulators, what are referred to as jet aerators, which are intended to form a homogeneous, non-sputtering and sparkling and soft water jet have also been provided.

DE-U 93 14 990 belonging to the applicant has previously disclosed a jet aerator which, in the mounting housing thereof, has a perforated plate which serves as a jet splitter and has a number of flow-through holes to produce a multiplicity of individual jets. Pins are provided in the discharge region of the flow-through holes, the free pin end of which pins, the pin end facing the perforated plate and converging conically to a point, being designed as a deflecting slope which in each case deflects one of the individual jets coming from the flow-through holes in a manner obliquely with respect to the direction of flow. In order to be able to fit the mounting housing of said previously known jet aerator at the water outlet of a sanitary outlet fitting, a sleeve-shaped outlet mouthpiece, into which the mounting housing can be inserted as far as an insertion stop, is provided. The outlet mouthpiece is provided with a thread which can be screwed to a corresponding mating thread on the water outlet.

The external appearance of the outlet fitting is determined by the water outlet and the adjacent outlet mouthpiece and the screw connection thereof to the water outlet. In order to provide an aesthetically pleasing appearance, the visible surfaces of the outlet mouthpiece, on the one hand, and of the outlet fitting in the region of the water outlet thereof, on the other hand, have to be configured as homogeneously as possible. Nevertheless, a narrow gap remains between the outlet mouthpiece and jet regulator insert, which gap has a tendency to become soiled and may have an interfering effect.

A sanitary fixture which likewise serves as a jet aerator and has a multi-part mounting housing has therefore also been provided, said mounting housing having, on the outer circumference thereof, an external thread for screwing into an internal thread provided on the inner circumference of the water outlet of a sanitary outlet fitting (cf. DE 10 2005 010 551 A1). A flow straightener is integrally formed on the mounting housing on the downstream side, the flow straightener being designed as a perforated plate which has flow-through holes and forms the downstream housing end side. A plurality of grate-shaped insertion parts can be inserted into the housing interior of the mounting housing, the insertion parts serving as a jet-regulating device which has to reform the individual jets aerated in the housing interior into a homogeneous, non-sputtering combination jet. The downstream housing end border has a profiling which can serve as a tool engagement surface for the corresponding profiling of a further mounting housing used as a rotation tool. Since the previously known jet aerator from DE 10 2005 010 551 A1 can be screwed into the water outlet of a sanitary outlet fitting to a depth such that the downstream housing end side of the mounting housing does not protrude beyond the water outlet of the outlet fitting, the aesthetic impression is determined solely by the outlet fitting. However, in order to be able to fit or remove the mounting housing to or from the water outlet of the outlet fitting, a further mounting housing or another special rotation tool, which is not always available in particular in a household, is required.

U.S. Pat. No. 4,534,513 has therefore also previously disclosed a jet regulator with a sleeve-shaped mounting housing which, on the downstream housing circumference thereof, bears an external thread to which the mounting housing can be screwed by means of an internal thread provided on the inner circumferential side of the water outlet of the outlet fitting. The mounting housing has a downstream housing end side which is formed by metal sieve layers lying one above another and which is guided displaceably in the interior of the mounting housing. By means of action upon said downstream housing end side with a coin, the housing end side is advanced into the housing interior in such a manner that a slot is exposed, the slot receiving the narrow side of the coin and serving as a tool engagement surface for the coin, which is used as a rotation tool. However, the displaceability of the housing end surface has the consequence that the flow conditions in the housing interior of the previously known jet regulator may change, and therefore the previously known jet regulator may not have a consistent and in particular a consistent and in particular a consistently good jet quality and requires a large amount of construction space.

Comparable jet regulators which have, on the downstream housing end side thereof, tool engagement surfaces for a simple rotation tool have also previously been disclosed in WO 2006/094680 A1, CH-C 380042, US 2002/0084353 A1, U.S. Pat. Nos. 3,014,667 and 4,534,514.

SUMMARY

It is therefore in particular the object to provide a sanitary fixture of the type mentioned at the beginning, which is distinguished by simple handling and which nevertheless constitutes an at least equivalent alternative in respect of function and aesthetic appearance of the outlet fitting to the fixtures which can be fitted with an outlet mouthpiece.

According to a proposal of the invention for achieving said object, the fixture has an aerated jet regulator or is configured as such, in that the circumferential wall of the mounting housing borders at least one aeration duct at least in a subregion of at least double-walled configuration, and in that the at least one aeration duct, which is open towards the downstream housing end side, opens out in at least one aeration opening leading into the housing interior of the mounting housing.

The fixture according to the invention has a single- or multi-part mounting housing which, on the outer circumference thereof, has an external thread which is intended for screwing into an internal thread provided on the inner circumference of the water outlet of a sanitary outlet fitting.

With the aid of the external thread provided on the mounting housing, the fixture according to the invention can optionally also be screwed into the internal thread on the water outlet to a depth until the fixture scarcely still protrudes, if at all, over the water outlet. In this case, the mounting housing is provided with a downstream housing end side which has flow-through holes through which the water flowing through the fixture can be discharged. At least one insertion part can be inserted into the mounting housing as far as an insertion stop, which insertion part has to shape and/or to regulate the water flowing through.

According to the abovementioned proposal of the invention, the fixture has an aerated jet regulator or is configured as such. The circumferential wall of the mounting housing borders at least one aeration duct at least in a subregion which is of at least double-walled configuration, said aeration duct being open towards the downstream housing end side and opening out in at least one aeration opening leading into the interior of the mounting housing. Ambient air can therefore be sucked up through the aeration duct, which is open towards the downstream housing end side, and can be conducted via the at least one aeration opening into the housing interior where said ambient air is mixed with the water, which is optionally temporarily divided into individual jets, in order to produce a sparkling and soft stream of water. Since the at least one aeration duct is integrated into the circumferential wall of the mounting housing, the fixture according to the invention can be fitted by the external thread thereof even into internal threads which are also intended for receiving an outlet mouthpiece. It is therefore possible either to make recourse to a conventional jet regulator which, for installation purposes, requires an outlet mouthpiece, or, however, instead use may be made of the fixture according to the invention which is no longer dependent on an outlet mouthpiece. Since the fixture according to the invention is no longer dependent on an outlet mouthpiece, and since an outlet mouthpiece of this type has previously generally been produced from brass and the production process had to be ended with the brass part being chromium-plated, the costs associated with the provision of such a material are avoided, the supply of material independently of said metal is ensured and an environmentally harmful chromium-plating operation can be dispensed with.

According to a further proposal of the invention, for which protection is claimed independently, it is provided, in addition or instead, that the downstream housing end side is of convexly or spherically curved design in the downstream direction and has at least one slot, the opposite slot longitudinal sides of which are configured as rotation or tool engagement surfaces for a rotation tool which can be inserted releasably into the at least one slot.

In this proposal of the invention, the fixture according to the invention has, on the downstream housing end side thereof, at least one slot, the opposite slot longitudinal sides of which are configured as rotation engagement surfaces or tool engagement surfaces for a rotation tool which can be inserted releasably into the at least one slot. In this case, the downstream housing end side is of convexly or spherically curved design in the downstream direction such that the slot can be configured to have a sufficient depth in order to provide a sufficient rotation or tool engagement surface for the rotation tool on the correspondingly deep slot longitudinal sides without thereby losing an excessive amount of space in the housing interior.

In order to be able readily to shape the water jet emerging from the fixture without the downstream housing end side providing high flow resistance because of this, it is expedient if the downstream housing end side is configured as a grate, mesh or perforated structure.

The at least one slot may be configured as a slotted aperture in the housing end surface. By contrast, according to a preferred embodiment of the invention, the at least one slot has a slot or groove base which is configured to be closed, or to be open or liquid-permeable—for example by means of a perforated or grate structure forming the slot or groove base.

In order to configure the slot longitudinal sides, which serve as the rotation or tool engagement surfaces, to be sufficiently stable, and in order to be able to transmit an appropriately high torque to said slot longitudinal sides, it is advantageous if the housing end surface has a cross-sectional thickened portion at least in the region of the at least one slot.

It is particularly advantageous if the slot longitudinal sides have a greater wall thickness in comparison to the flow-guiding walls forming the grate, mesh or perforated structure of the housing end surface.

According to a further proposal of the invention of independent significance which is worthy of protection, the mounting housing has a downstream housing section with a housing cross section which is reduced in relation to the adjacent, inflow housing section, and the free end border of the downstream housing section protruding over the water outlet serves as a drip edge.

A sanitary fixture configured as per this proposal of the invention has a downstream housing section which has a reduced housing cross section in relation to the adjacent, inflow housing section. In this case, the free end border of the downstream housing section protruding over the water outlet is configured as a drip edge at which the residual water still emerging after the stop-cock has been closed can drip without overflowing onto the outer side of the outlet fitting and running therealong.

In order to be able thoroughly to mix the water flowing through the fixture according to the invention uniformly with ambient air over the entire cross section of said fixture, it is advantageous if a plurality of aeration openings preferably distributed uniformly over the housing circumference are provided.

In order to accommodate the at least one aeration duct in the circumferential wall of the mounting housing with little outlay, it is advantageous if the mounting housing has, at least in a downstream housing section, an outer housing wall bearing at least a subsection of the external thread and an inner housing wall which is spaced apart therefrom by the at least one aeration duct.

In this case, the inner housing wall can at the same time also be configured as a drip edge if the inner housing wall protrudes over the outer housing wall and forms the downstream housing end border.

In order to be able readily to screw the fixture according to the invention to the internal thread, which is provided on the inner circumferential side of the water outlet of an outlet fitting, using an appropriate rotation tool, it is advantageous if the inner and outer housing walls are connected to each other via preferably radial webs, and if at least two webs are provided as rotation or tool engagement surfaces for a rotation tool which can be introduced into the clearance between the webs.

If the fixture according to the invention is configured as a jet aerator, the ambient air can be sucked up into the interior of the mounting housing by means of a negative pressure. According to a preferred embodiment of the invention, the jet regulator has an insertion part which is designed as a jet splitter and divides the stream of water into a multiplicity of individual jets, and the at least one aeration opening is arranged in a housing interior section following the jet splitter in the direction of flow. Since the inflowing stream of water in the jet splitter is divided into a multiplicity of individual jets, and since said individual jets undergo an increase in velocity in the region of the cross-sectional narrowing caused by the jet splitter, a negative pressure is generated as per Bernoulli's equation on the downstream side of the jet splitter, the negative pressure causing the ambient air to be sucked up into the housing interior.

So that as high a negative pressure as possible is produced on the downstream side of the jet splitter and so that the water flowing through the fixture according to the invention can be readily and effectively mixed with the ambient air, it is advantageous if the jet splitter has a multiplicity of flow-through openings for dividing the stream of water into a multiplicity of individual jets.

It is possible for the jet splitter to be designed as a perforated plate or as a diffuser. However, according to a preferred embodiment of the invention, the jet splitter which is designed as a diffuser has an annular wall which bears the flow-through openings and on which a central impact surface is integrally formed on the downstream side, said impact surface deflecting the inflowing stream of water in the direction of the circumferential flow-through openings.

It is expedient if a diffuser ring is provided, which diffuser ring engages around the diffuser at least in the region of the flow-through openings, and if a flow-through duct tapering in the direction of flow is provided between the inner circumference of the diffuser ring and the outer circumference of the diffuser. The water divided into individual jets in the region of the diffuser is accelerated in the flow-through duct provided between the diffuser and diffuser ring in such a manner that a comparatively high negative pressure can be generated even with small quantities of water in the region of said flow-through duct.

So that the homogeneous jet pattern of the emerging water jet is not impaired, it is advantageous if the diffuser ring shields the at least one aeration opening at a distance such that the adjacent subregion of the diffuser ring serves as a splash guard for the at least one aeration opening against the water flowing past the diffuser ring on the inner circumferential side.

In order to allow the ambient air to flow in particular into the region directly adjoining the jet splitter without the water being able to penetrate there through the aeration openings into the aeration duct and being able to escape from there into a region outside the jet zone, it is expedient if the diffuser ring has at least one air flow-through opening, and if the at least one air flow-through opening narrows in the flow-through direction preferably to form an air flow-through slot.

In order to be able to place and fit the insertion housing and the diffuser ring, and the diffuser ring and the diffuser in a precise position with respect to one another, it is expedient if the diffuser ring can be inserted into the mounting housing and/or the diffuser can be inserted into the diffuser ring as far as an insertion stop.

So that the individual parts of the fixture according to the invention cannot become unintentionally released from one another during transport or storage, it is advantageous if the diffuser ring can be fixed releasably and preferably can be latched releasably in the insertion housing and/or the diffuser can be fixed releasably and preferably can be latched releasably in the diffuser ring. In this case, according to a preferred embodiment of the invention, an annular step or annular flange which interacts with the insertion stop is provided on the diffuser ring and/or on the diffuser.

So that the water flowing through can be adjusted to a maximum water volume per unit of time independently of the pressure, it is advantageous if the fixture has a flow-through quantity regulator connected upstream of the aerated jet regulator in the direction of flow.

So that the dirt particles entrained in the water do not lead to functional impairments in the successive functional units of the fixture according to the invention, it is expedient if an ancillary sieve is connected upstream of the preferably aerated jet regulator and optionally the flow-through quantity regulator in the direction of flow.

In order to avoid leakage flows past the outer circumference of the mounting housing, it is advantageous if an annular seal of preferably flexible material is provided for axial sealing between the fixture and an annular step located in the water outlet.

Further features of the invention emerge from the description below of exemplary embodiments according to the invention in conjunction with the claims and the drawing. The individual features can be implemented each by themselves or more than one together in an embodiment according to the invention.

DETAILED DESCRIPTION OF THE PREFERRED EMBODIMENTS

Figure 2:
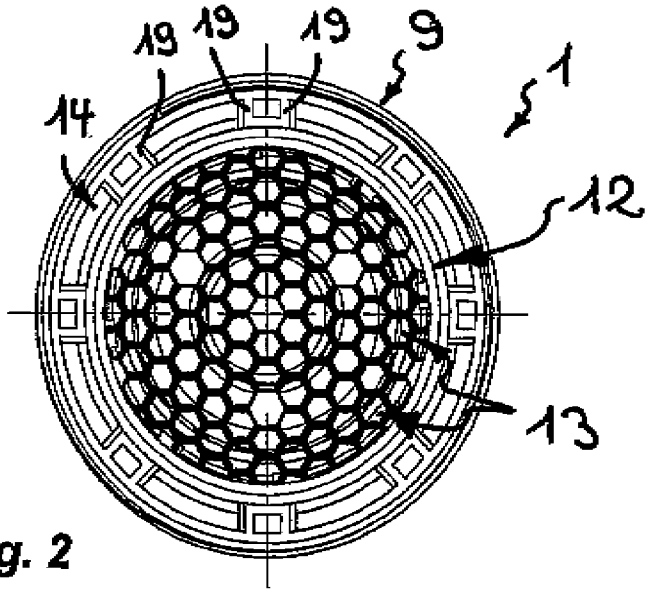
FIG. 2 shows the fixture from FIG. 1 in a top view of the outlet end side thereof.
Figure 4:
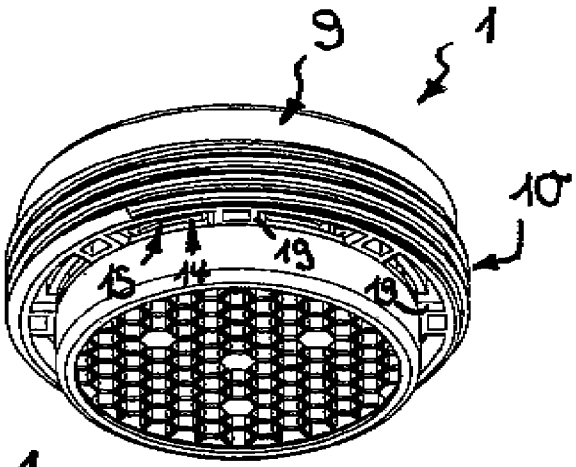
FIG. 4 shows the fixture from FIGS. 1 to 3 in a perspective top view of the outlet end side thereof.
Figure 1:
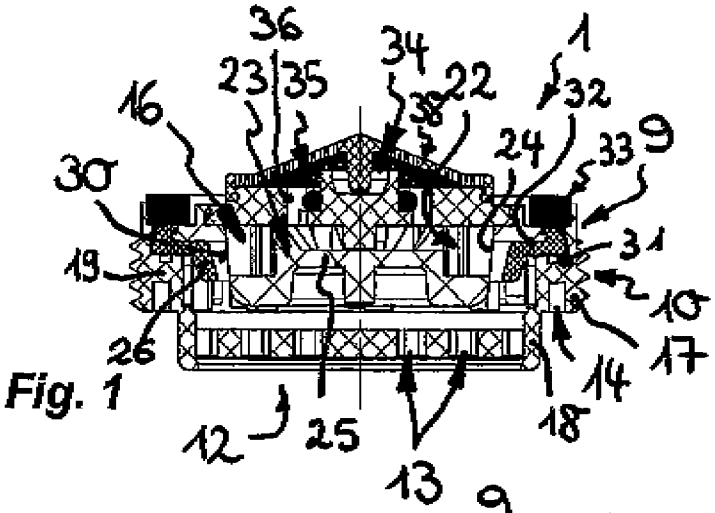
FIG. 1 shows a sanitary fixture, which is illustrated in a longitudinal section (in the sectional plane I-I according to FIG. 3), with a mounting housing which bears, on the outer circumference thereof, an external thread which can be screwed into an internal thread in the water outlet of a sanitary outlet fitting, wherein a diffuser which serves as a jet splitter and around which a diffuser ring, which is comparatively short here, engages can be inserted into the mounting housing.
Figure 3:
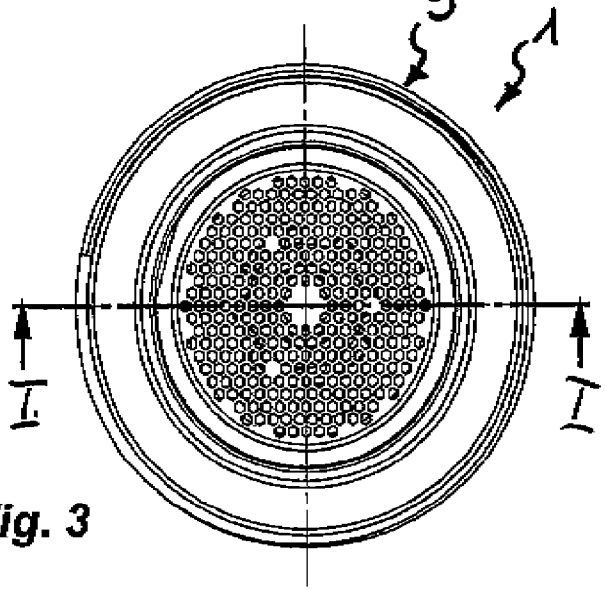
FIG. 3 shows the fixture from FIGS. 1 and 2 in a top view of the inflow end side thereof, wherein the perforated area of an ancillary sieve which can be latched releasably to the inflow end side can readily be seen.
Figure 5:
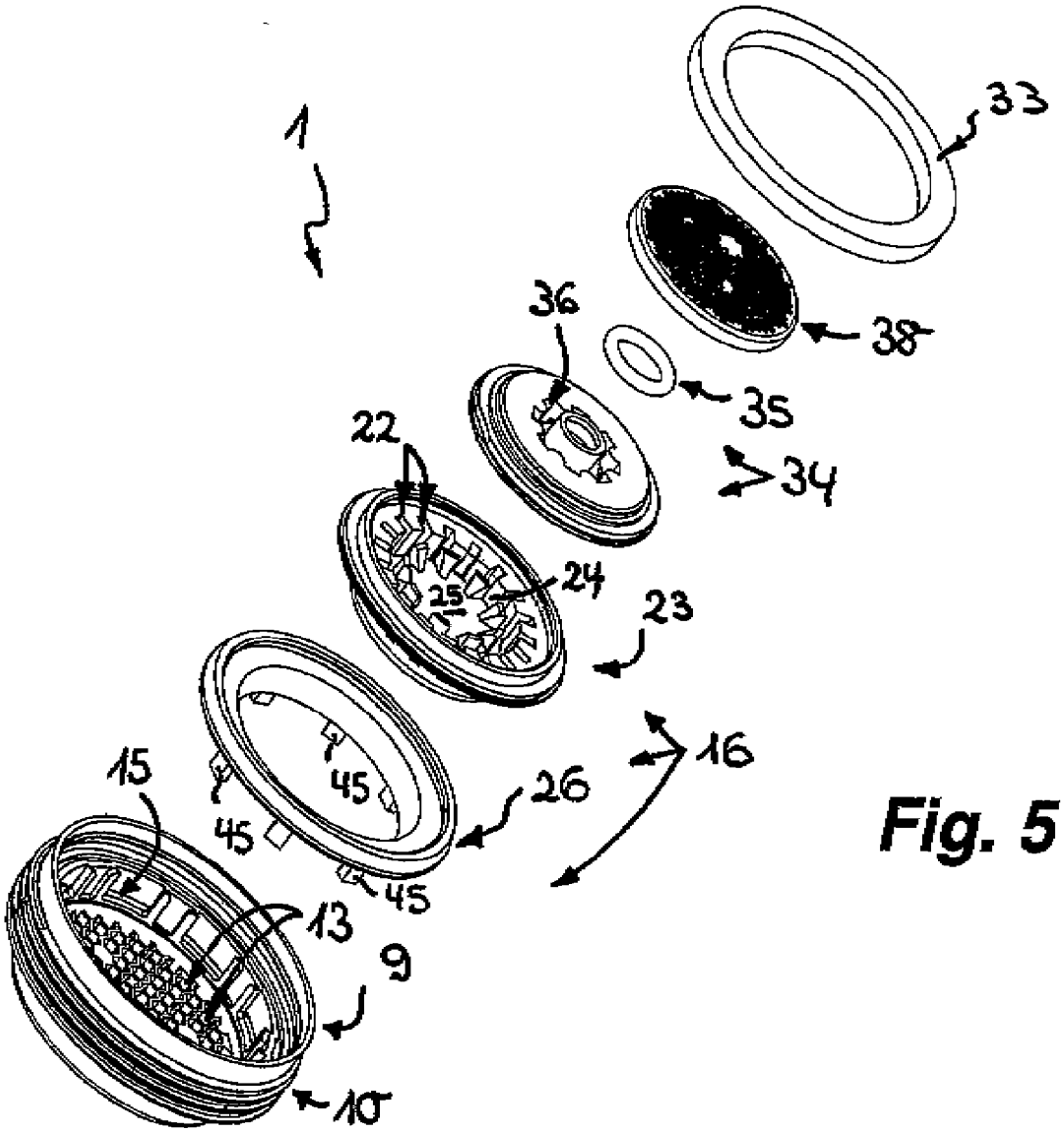
FIG. 5 shows the fixture from FIGS. 1 to 4 in an extended perspective illustration of the individual parts.
Figure 6:
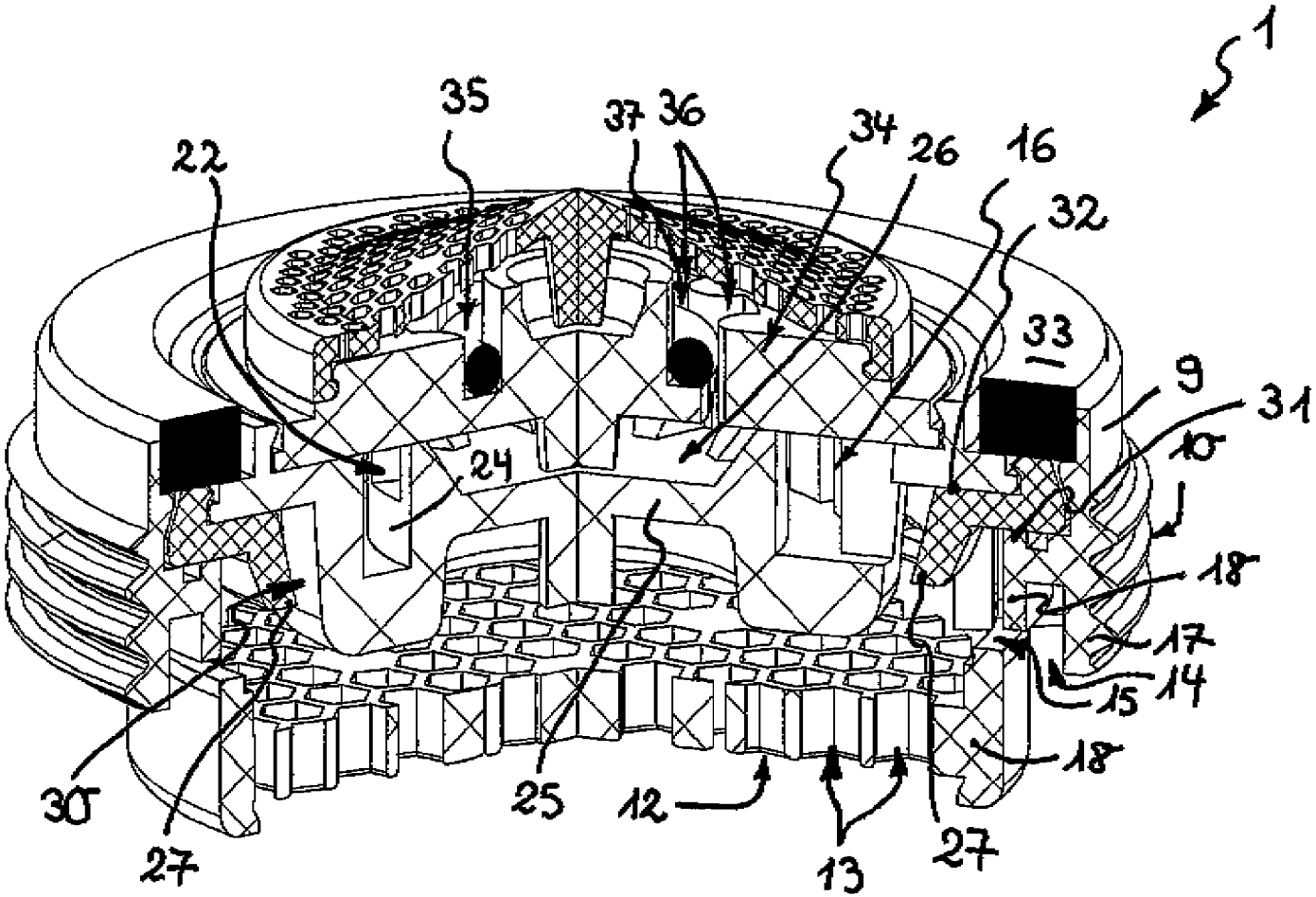
FIG. 6 shows the fixture from FIGS. 1 to 5 in a perspective partial longitudinal section.
Figure 8:
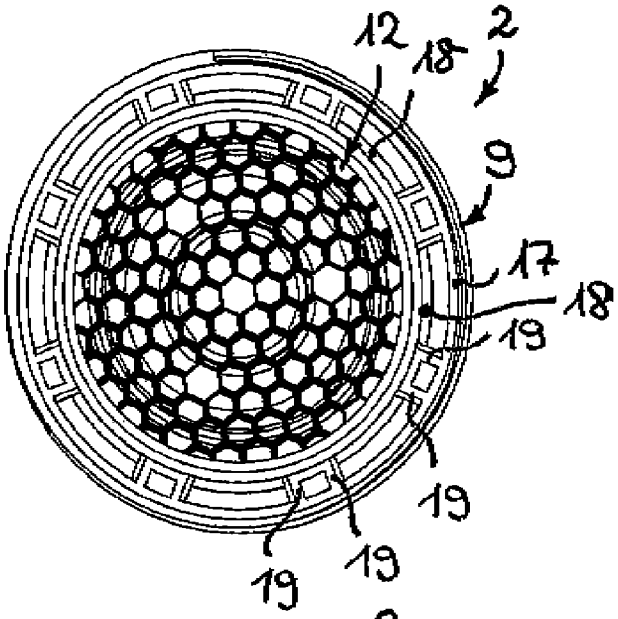
FIG. 8 shows the fixture from FIG. 7 in a top view of the outlet end side thereof.
Figure 10:
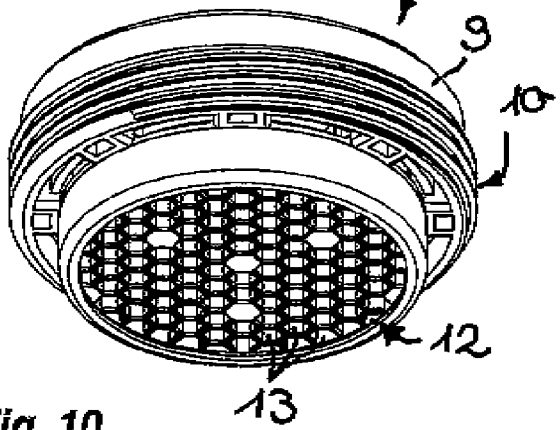
FIG. 10 shows the fixture from FIGS. 7 to 9 in a perspective top view of the outlet end side.
Figure 7:
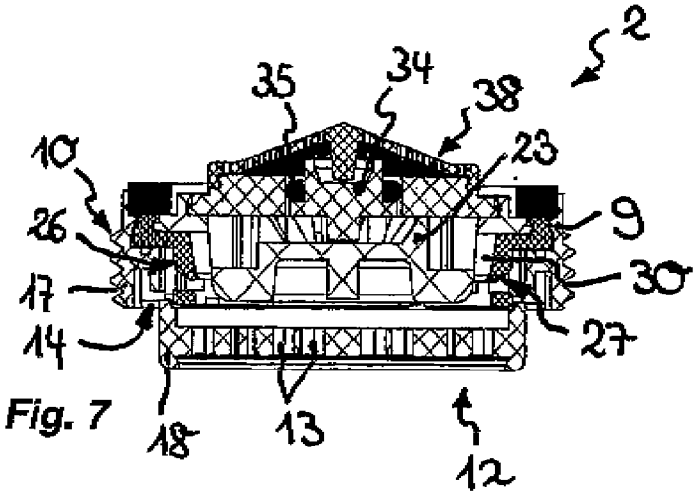
FIG. 7 shows a sanitary fixture which is comparable to FIGS. 1 to 6 and likewise has an aerated jet regulator and with a diffuser ring which reaches here approximately as far as the downstream end side of the diffuser.
Figure 9:
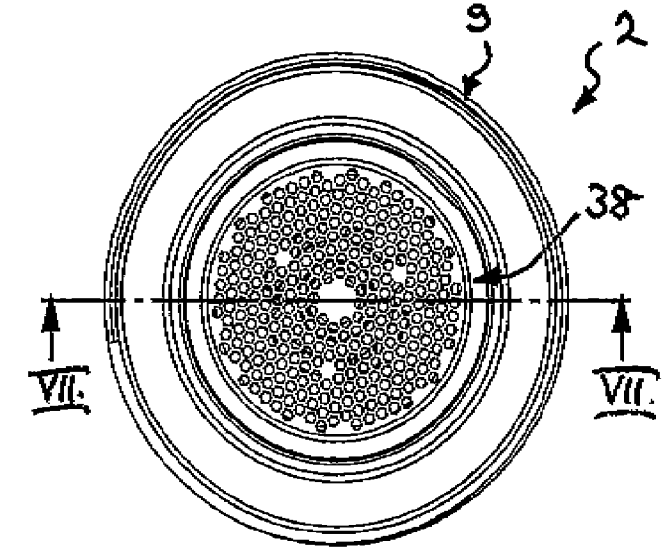
FIG. 9 shows the fixture from FIGS. 7 and 8 in a top view of the inflow end side.
Figure 11:
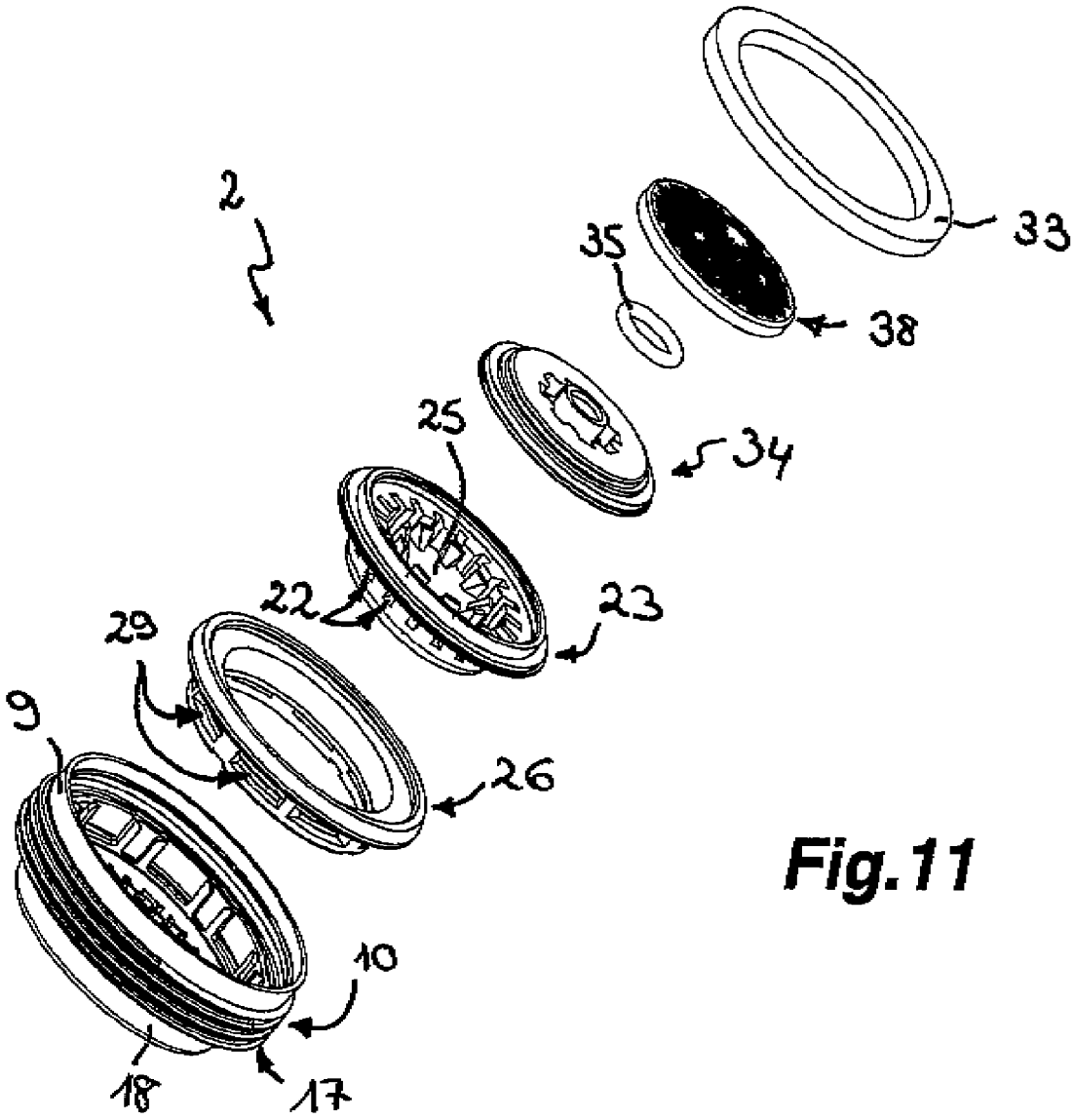
FIG. 11 shows the fixture from FIGS. 7 to 10 in a perspective illustration of the individual parts.
Figure 12:
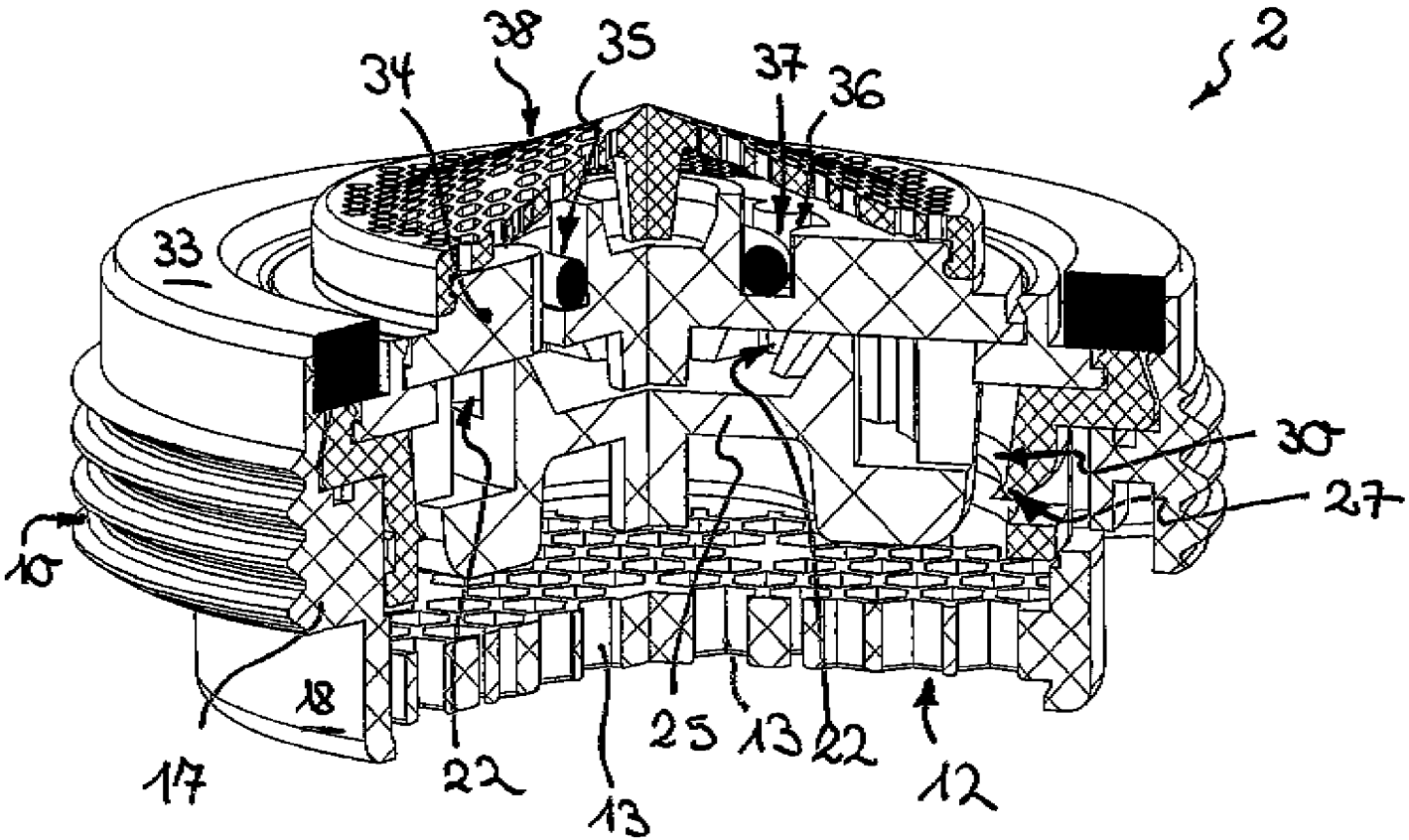
FIG. 12 shows the fixture from FIGS. 7 to 11 in a perspective partial longitudinal section.

FIGS. 1 to 12 and 14 to 27 illustrate various embodiments 1, 2, 4, 5, 6 and 7 of a sanitary fixture. The fixtures 1, 2, 4, 5, 6 and 7 illustrated here can be fitted to the water outlet 70 of a sanitary outlet fitting 8 (otherwise not shown further here). The fixtures 1, 2, 4, 5, 6 and 7 have a mounting housing 9 which has an external thread 10 on the outer circumference thereof. The external thread 10 is intended for screwing into an internal thread 11 which is provided on the inner circumference of the water outlet 70 of the sanitary outlet fitting 8 (cf. FIG. 14). The mounting housing 9 has a downstream housing end side 12 with flow-through holes 13.

The circumferential wall of the mounting housing 9 of the fixtures 1, 2, 4, 5, 6 and 7 illustrated here bounds an annularly encircling aeration duct 14 in a subregion of double-walled configuration. Said aeration duct 14, which is open towards the downstream housing end side 12, which is at the bottom in the figures, opens out in a plurality of aeration openings 15 which are distributed uniformly over the housing circumference and lead into the interior of the mounting housing 9. The aeration duct 14 and the aeration openings 15 are part of a jet regulator 16, a "jet aerator", which is integrated in the fixtures 1, 2, 4, 5 and 6. By contrast, the fixture 7 is itself configured as a jet regulator.

The mounting housing 9 of the fixtures 1, 2, 4, 5, 6 and 7 has, in the downstream housing section thereof, an outer housing wall 17 and an inner housing wall 18 which is spaced apart therefrom by the aeration duct 14, of which housing walls the inner housing wall 18 protrudes over the outer housing wall 17 and forms the downstream housing end border. The outer housing wall 17 bears at least one subsection of the external thread 10. The inner and the outer housing walls 17, 18 are connected to each other via radial webs 19, wherein the webs 19 are provided as a rotation or tool engagement surface for a rotation tool which can be introduced into the clearance between the webs 19.

Since, however, a special rotation tool of this type is not always available, in particular in a private household, the downstream housing end side 12 of the fixtures 5, 6 and 7 illustrated in FIGS. 15 to 27 has at least one slot 20, 21, the opposite slot longitudinal sides of which are configured as rotation or tool engagement surfaces for a rotation tool which can be inserted releasably into the at least one slot 20 or 21. A screwdriver, but preferably also a coin, can serve as the rotation tool. So that a higher torque can also be transmitted with the aid of the rotation tool which can be introduced into the slot 20, 21, the downstream housing end side 12 is convexly or spherically curved in the downstream direction, and therefore the slot longitudinal sides are preferably configured to be deep without the housing end side 12 substantially restricting the space available in the housing interior. There is therefore sufficient space in the housing interior in order to provide further insertion parts or flow-shaping parts 47, 48 therein (cf. FIG. 27). Whereas the jet regulator 5 according to FIGS. 15 to 20 bears only one approximately radially oriented slot 20 on the housing end side thereof, two radially oriented slots 20, 21 which are arranged at right angles to each other and form a cross recess here are provided on the housing end side 12 of the fixture 6 shown in FIGS. 21 to 26.

At least one insertion part can be inserted into the mounting housing 9 of the fixtures 1, 2, 4, 5, 6 and 7 as far as an insertion stop. It is thus clear from FIGS. 1 to 12 and 14 to 26 that an insertion part which is designed as a jet splitter can be inserted into the mounting housing 9 of the fixtures 1, 2, 4, 5, 6 and 7, which insertion part has to divide the stream of water into a multiplicity of individual jets and, for this purpose, has a multiplicity of flow-through openings 22. The insertion part serving as the jet splitter is designed here as a diffuser 23 which has an annular wall 24 bearing the flow-through openings 22. A central impact surface 25 which deflects the inflowing stream of water in the direction of the circumferential flow-through openings 22 is integrally formed on the annular wall 24 of the diffuser 23, which is cup-shaped here.

A diffuser ring 26 engages around the diffuser 23 in such a manner that a flow-through duct 30 tapering in the direction of flow is provided between the inner circumference of the diffuser ring 26 and the outer circumference of the diffuser 23. In this case, the aeration openings 15 are covered by the diffuser ring 26 at a distance in such a manner that the adjacent subregion of the diffuser ring 26 serves as a splash guard 27 for the ventilation openings 15 against the water flowing past the diffuser ring 26 on the inner circumferential side.

The diffuser ring 26 of the fixtures 2, 5 and 6 has air flow-through openings 29 which narrow in the flow-through direction to form an air flow-through slot. The ambient air can therefore be sucked up via the aeration duct 14 through the aeration openings 15 in the circumferential wall and the air flow-through openings 29 in the diffuser ring 26 into the interior of the mounting housing 9 in order to mix there with the individual jets produced by the diffuser 23 before said individual jets are combined again and shaped at the housing end side 12, which serves as a flow straightener, to form a homogeneous, non-sputtering and sparkling and soft, aerated combination jet.

The jet regulator 16 which is integrated into the fixtures 1, 2, 4, 5 and 6 therefore essentially consists of the diffuser 23, the associated diffuser ring 26 and the housing end side 12 of the mounting housing 9, which housing end side is designed as a flow straightener.

Figure 27:
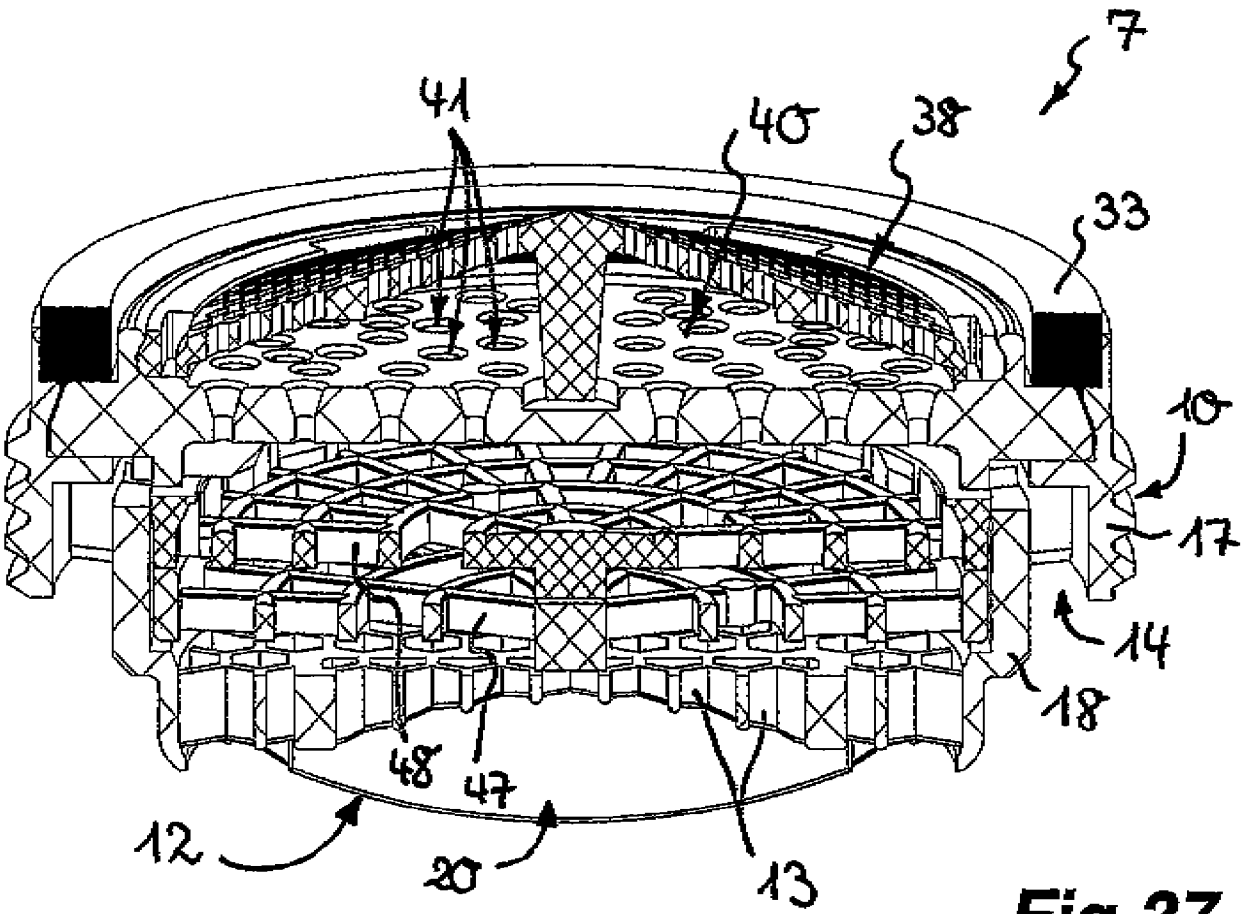
FIG. 27 shows a fixture which is designed as a jet regulator and is comparable to the fixture in FIGS. 15 to 20, in a longitudinal section, wherein the jet regulator here has a jet splitter which is designed as a perforated plate which has a multiplicity of axial flow-through holes in order to divide the inflowing water into a corresponding number of individual jets.

Whereas, in the fixtures 1, 2, 4, 5 and 6, the jet splitter is designed as a diffuser 23, the fixture 7, which is designed as a jet regulator, in FIG. 27 instead has a jet splitter which is configured as a perforated plate 40 which, in order to divide the inflowing water into a multiplicity of individual jets, has a corresponding number of axial flow-through holes 41.

In order to be able to suck up the ambient air into the housing interior and, for this purpose, to generate a negative pressure in the housing interior, an annular flow-through duct 30 which tapers in the direction of flow is provided between the inner circumference of the diffuser ring 26 and the outer circumference of the diffuser 23. In said tapering flow-through duct 30, the individual jets which are separated in the diffuser 23 are accelerated in such a manner that a negative pressure is produced on the downstream side of the diffuser 23 in the region of the downstream opening in the flow-through duct 30.

Also in the case of the fixture 7 illustrated in FIG. 27, the passage cross section in the flow-through holes 41 in the perforated plate 40 is narrowed in such a manner that the individual jets produced by the perforated plate 40 are accelerated such that a negative pressure is also produced on the downstream side of the perforated plate 40.

Whereas the diffuser ring 26 can be inserted into the mounting housing 9 as far as an insertion stop 31, the diffuser 23, for its part, can be inserted into the diffuser ring 26 as far as an insertion stop 32. In this case, a sealing ring 33 of preferably flexible material is provided, the sealing ring sealing the separating gaps between the mounting housing 9 and diffuser ring 26, and between the diffuser ring 26 and diffuser 23, and being able to be clamped between the inflow end border of the mounting housing 9 and an annular step in the water outlet 7 of the sanitary outlet fitting 8 for axial sealing purposes.

It can be seen in FIGS. 1 to 12 and 14 to 26 that a flow-through quantity regulator 34 is connected upstream of the jet regulator of the fixtures 1, 2, 4, 5 and 6, the flow-through quantity regulator having an annular throttle body 35 of elastic material, which throttle body 35 between itself and a regulating profiling 36 bounds a control gap 37 which is changed by the pressure of the water flowing therethrough. Said flow-through quantity regulator 34 is connected via a latching connection to the jet regulator 16 following in the direction of flow and in particular to the diffuser 23 thereof. An ancillary sieve 38 which tapers conically counter to the direction of flow is in turn connected upstream of the flow-through quantity regulator 34 and has to filter out the dirt particles entrained in the water before said dirt particles can impair the function of the flow-through quantity regulator 34 or of the following jet regulator. A comparable ancillary sieve 38 is also provided upstream of the fixture 7.

Figure 14:
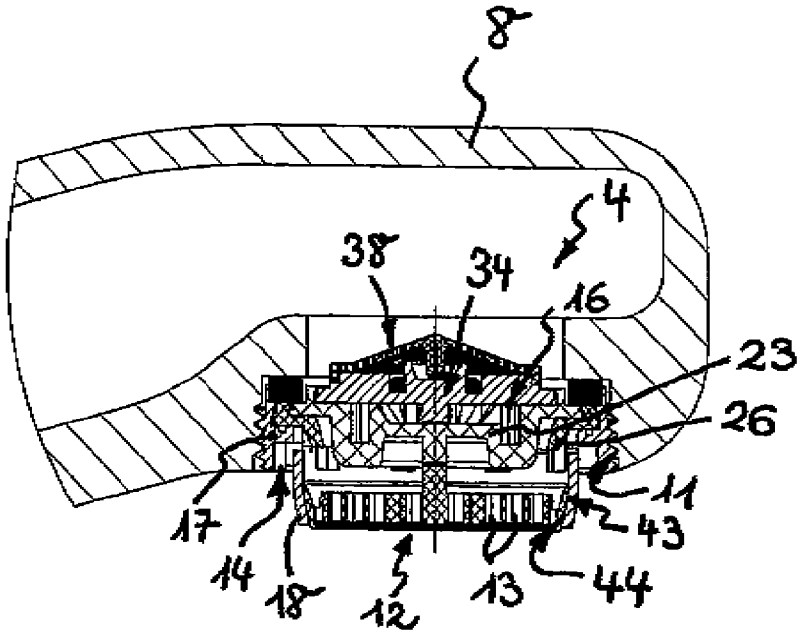
FIG. 14 shows a fixture which is comparable to FIGS. 1 to 12 and is screwed into the water outlet of the outlet fitting shown in FIG. 13, wherein the external thread, which is provided on the mounting housing of the fixture, is screwed into the internal thread which is provided in FIG. 13 for screwing to the outlet mouthpiece.
Figure 13:
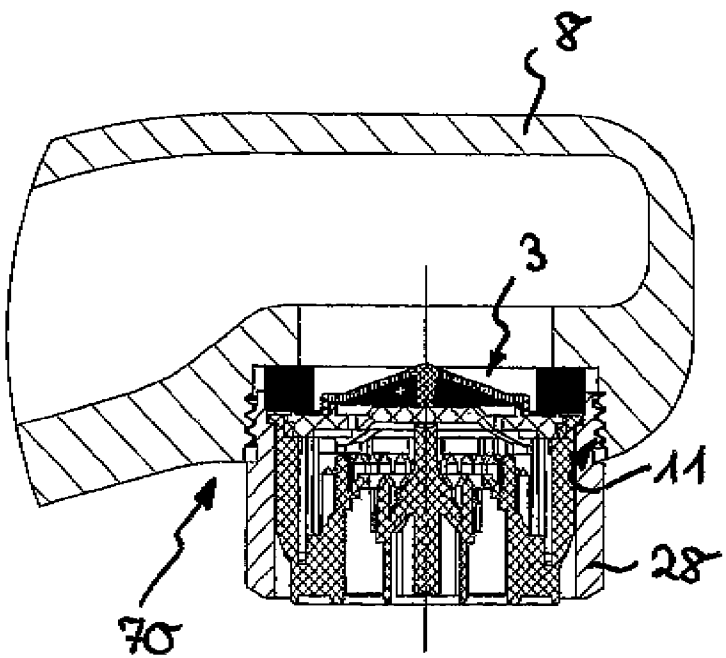
FIG. 13 shows an aerated jet regulator of a conventional type, which can be fitted to the water outlet of a sanitary outlet fitting with the aid of a separate outlet mouthpiece.
Figure 16:
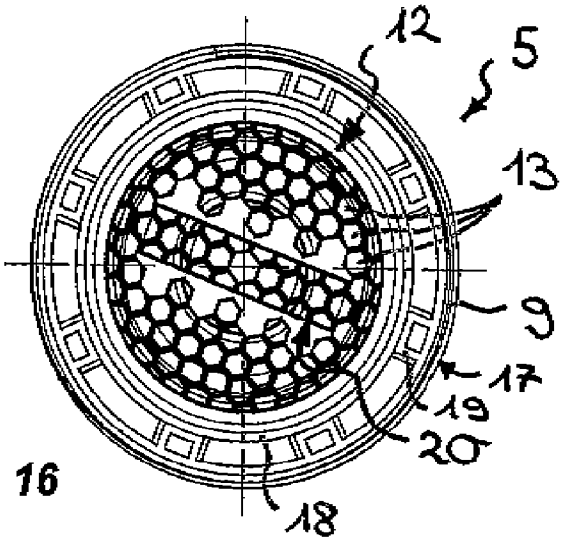
FIG. 16 shows the fixture from FIG. 15 in a top view of the outlet end side thereof.
Figure 18:
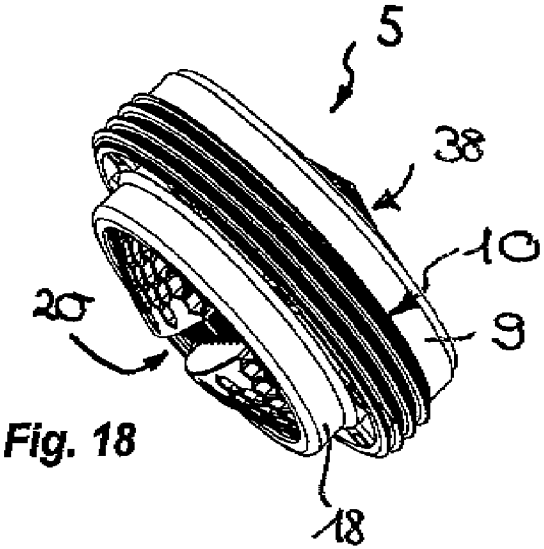
FIG. 18 shows the fixture from FIGS. 15 to 17 in a perspective side view.
Figure 15:
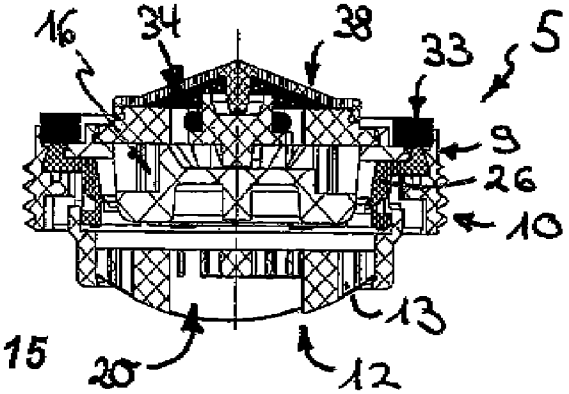
FIG. 15 shows a fixture comparable to FIGS. 1 to 12 and 14, in a longitudinal section, on the mounting housing of which a downstream housing end side is integrally formed, said housing end side having a radially oriented slot, the slot longitudinal sides of which serve as a rotation engagement surface, for example, for a coin which is introduced into the slot and is used as a rotation tool.
Figure 17:
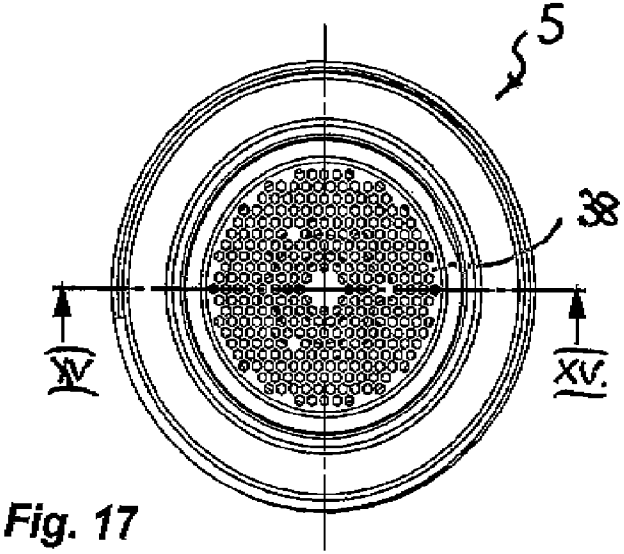
FIG. 17 shows the fixture from FIGS. 15 and 16 in a top view of the inflow end side thereof.
Figure 19:
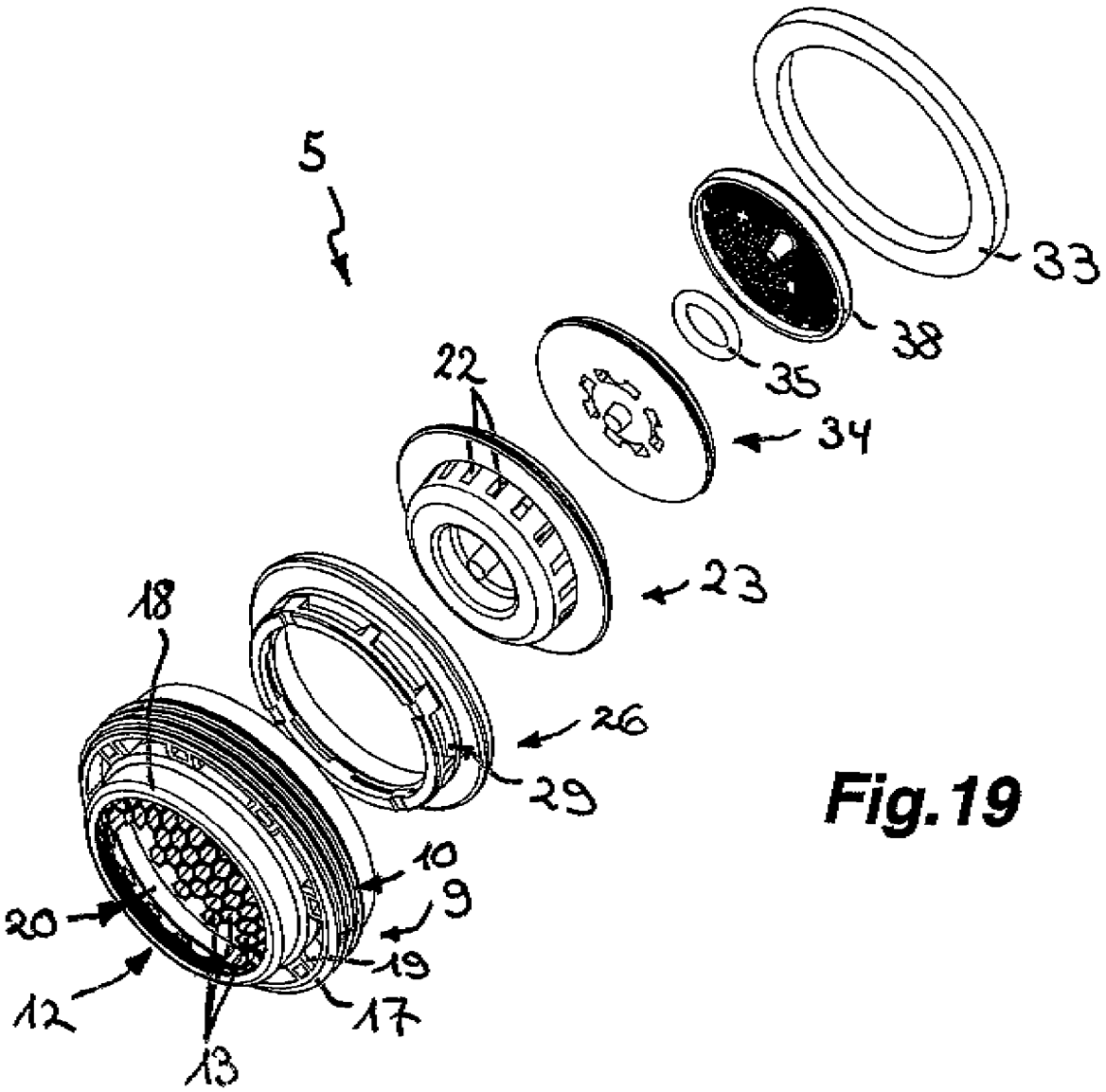
FIG. 19 shows the fixture from FIGS. 15 to 18 in a perspective illustration of the individual parts.
Figure 20:
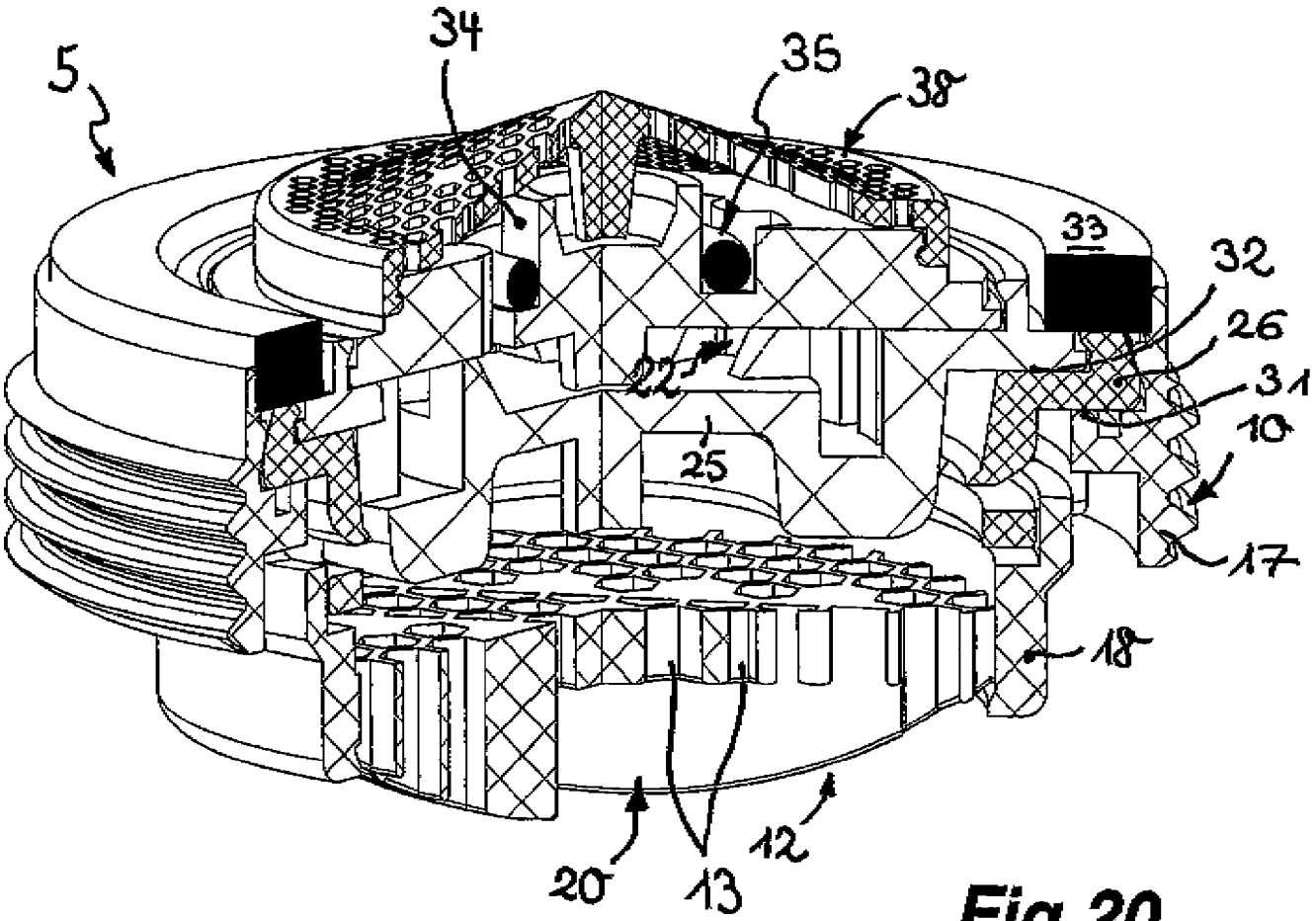
FIG. 20 shows the fixture from FIGS. 15 to 19 in a perspective partial longitudinal section.
Figure 22:
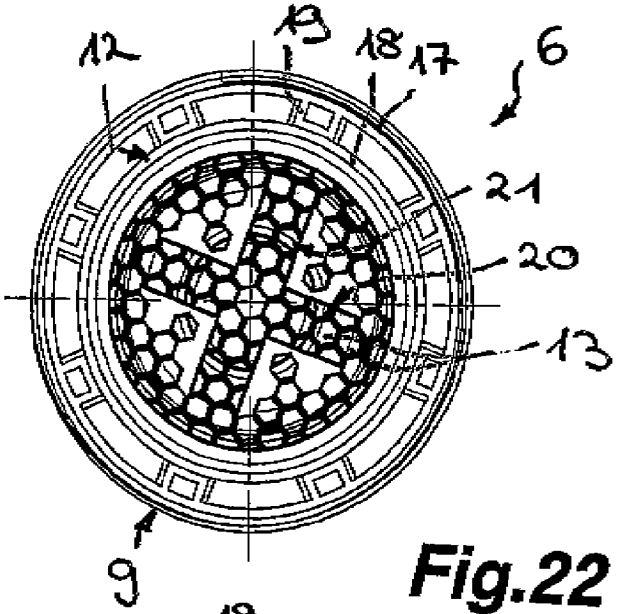
FIG. 22 shows the fixture from FIG. 21 in a top view of the outlet end side thereof.
Figure 24:
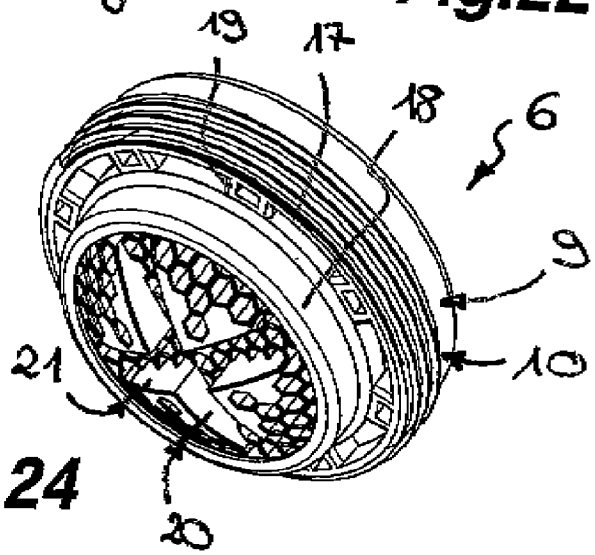
FIG. 24 shows the fixture from FIGS. 21 to 23 in a perspective top view of the outlet end side thereof.
Figure 21:
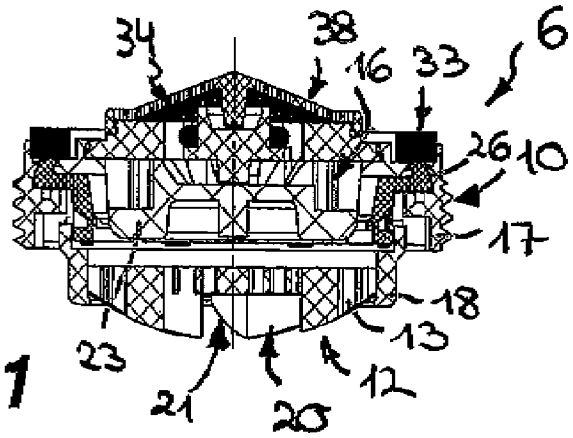
FIG. 21 shows a fixture which is comparable to FIGS. 15 to 20 and which has, on the downstream housing end side of the mounting housing thereof, two slots which intersect at right angles and form a cross recess.
Figure 23:
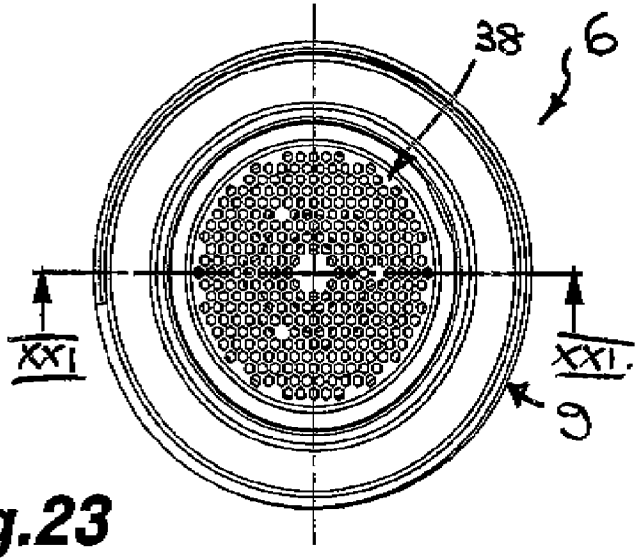
FIG. 23 shows the fixture from FIGS. 21 and 22 in a top view of the inflow end side thereof.
Figure 25:
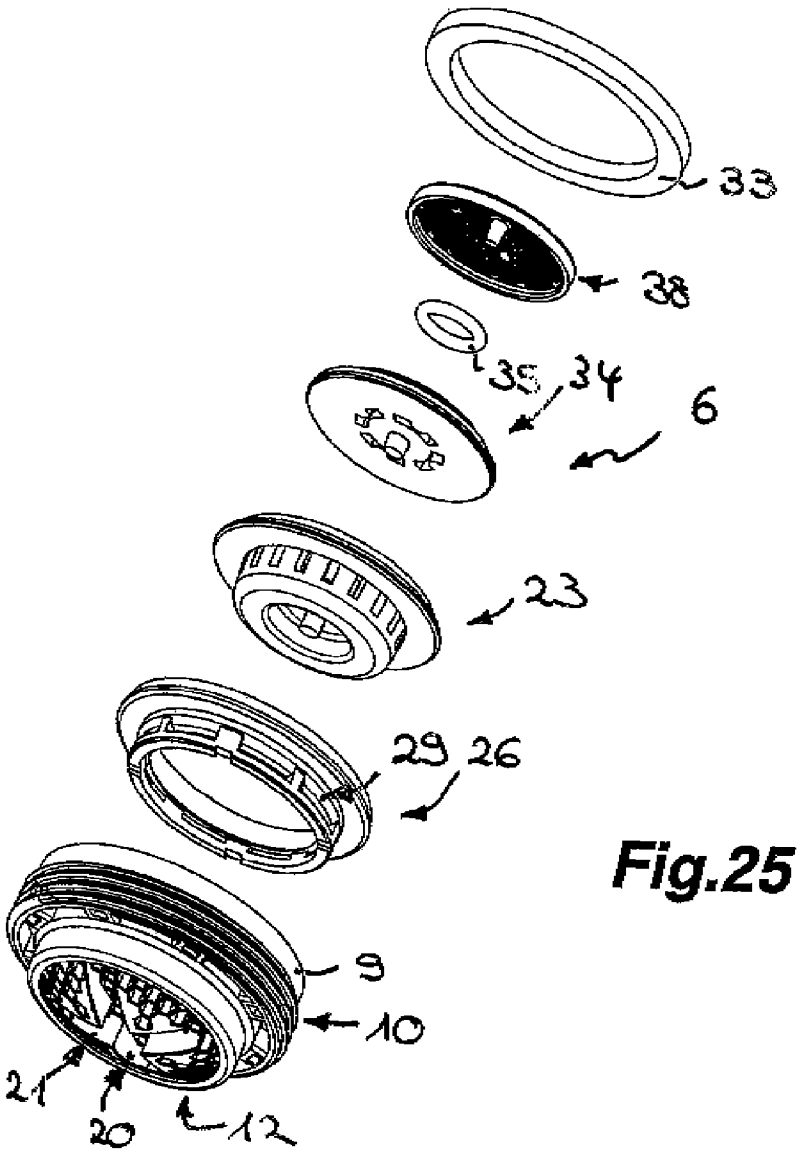
FIG. 25 shows the fixture from FIGS. 21 to 24 in a perspective illustration of the individual parts.
Figure 26:
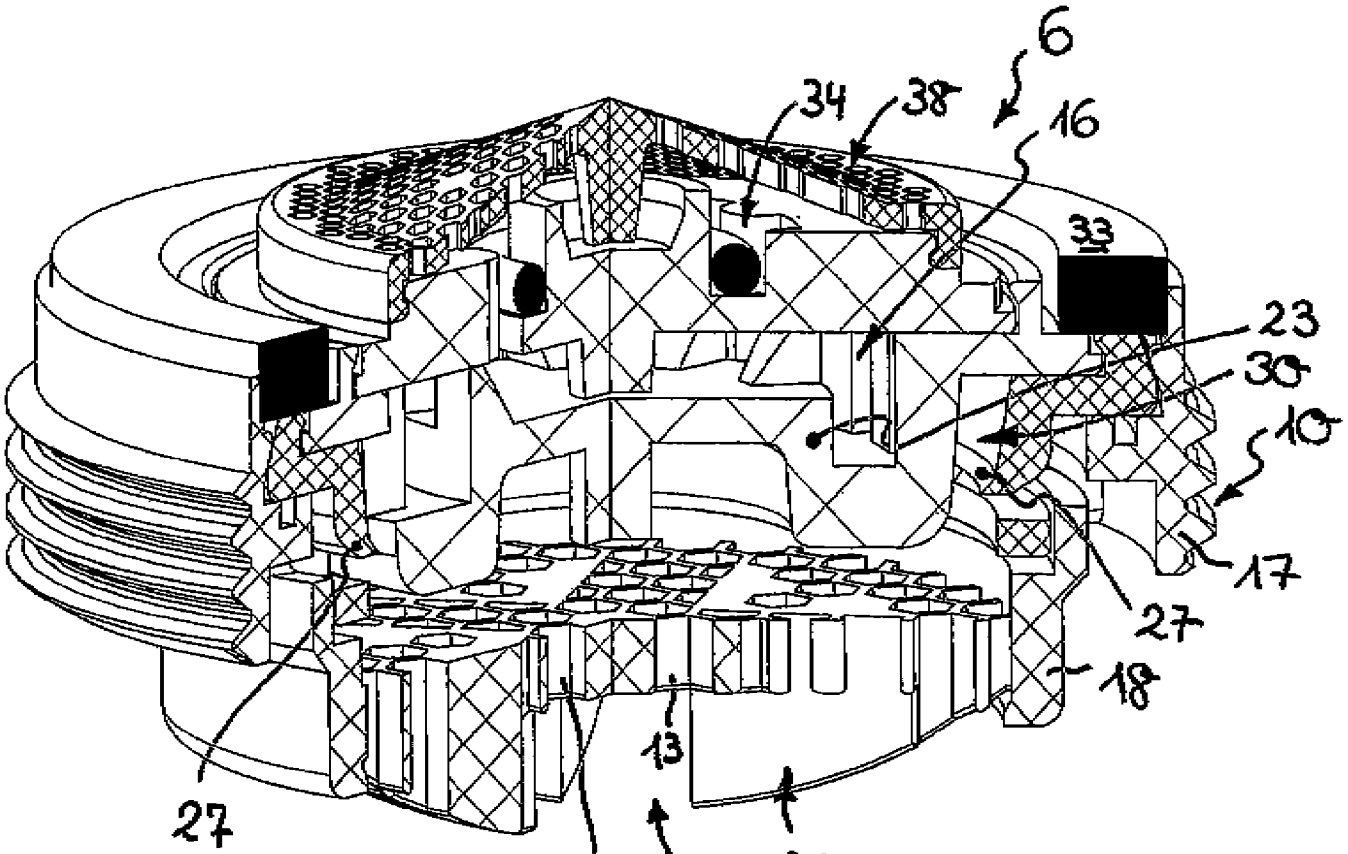
FIG. 26 shows the fixture from FIGS. 21 to 25 in a perspective partial longitudinal section.

It is clear from a comparison of FIGS. 13 and 14 that the fixtures 1, 2, 4, 5, 6 and 7 illustrated here can also be screwed by means of the external thread 10 thereof, which is provided on the mounting housing 9, into the internal thread 11 on the water outlet 7 of a sanitary outlet fitting, which internal thread is otherwise required for the mounting of the outlet mouthpiece 28 required for a commercially available jet regulator 3. It is thereby possible to use the outlet fitting shown in FIGS. 13 and 14 either in combination with an outlet mouthpiece 28 and a commercially available jet regulator 3 inserted therein, or else in combination with one of the fixtures 1, 2, 4, 5, 6 and 7 according to the invention.

It can be seen in FIG. 14 that the housing end side 12 can also be configured as a separate fixture and is inserted into the mounting housing 9 of the fixture 4. In this case, the outer circumference 43 of the housing end side 12, which is configured in the form of a disc, is of spherical-cap-shaped configuration and is held pivotably in a complementarily shaped socket 44 which is formed by a subregion of the inner circumferential wall of the housing 9. In order to be able to secure such a housing end side 12, which is produced as a separate fixture and is optionally also mounted pivotably in the housing 9, in the housing 9, it is expedient if pin-shaped projections 45 protrude on the downstream end border of the diffuser ring 26, said projections serving as a holding-down device or as a pivoting stop for the housing end side 12 which is configured as a separate fixture.

The invention claimed is:

1. A sanitary fixture (1, 2, 4, 5, 6, 7), having an upstream end and a downstream end, the sanitary fixture (1, 2, 4, 5, 6, 7) comprising a mounting housing (9) having a thread (10) which is matingly engagable with a thread (11) provided on a water outlet (70) of a sanitary outlet fitting (8), wherein the mounting housing (9) has a downstream housing end side (12) with flow-through holes (13), and wherein at least one insertion part can be inserted into the mounting housing (9) as far as an insertion stop, the fixture (1, 2, 4, 5, 6, 7) comprises: an aerated jet regulator which is configured such that a circumferential wall of the mounting housing (9) comprises at least one aeration duct (14) at least in a subregion of at least a double-walled configuration, and the at least one aeration duct (14), which is arranged within the housing, opens out in at least one aeration opening (15) leading into a housing interior of the mounting housing (9); and a throughflow regulator (34) which is connected to and upstream of a jet regulator (16), the jet regulator (16) comprises a diffuser (23) and a diffuser ring (26), and wherein the throughflow regulator (34) has an outermost periphery which is secured within an outer periphery of the diffuser (23).

2. The fixture according to claim 1, wherein an outermost periphery of the diffuser (23) is secured to an outer periphery of the diffuser ring (26).

3. The fixture according to claim 1, wherein the diffuser ring (26) can be inserted into the mounting housing (9) as far as the insertion stop (31), and wherein the diffuser (23), can be inserted into the diffuser ring (26) as far as an insertion stop (32) of the diffuser ring (26).

4. The fixture according to claim 1, wherein the thread (10) provided on the mounting housing (9) is an external thread which is arranged on an outer circumference of the housing (9) and interacts with an internal thread (11) which is located on an inner circumference of the water outlet (70) provided in the form of a mating thread (11).

5. The fixture according to claim 1, wherein the downstream housing end side (12) comprises tool engagement surfaces for a rotation tool which can matingly engage with the tool engagement surfaces.

6. The fixture according to claim 1, wherein the diffuser (23) is configured as a jet splitter and divides a stream of water into a multiplicity of individual jets, and the at least one aeration opening (15) opens out in a housing interior section following the jet splitter in a direction of flow.

7. The fixture according to claim 6, wherein the jet splitter has a multiplicity of flow-through openings (22, 41) for dividing the stream of water into the multiplicity of individual jets.

8. The fixture according to claim 1, further comprising an ancillary sieve (38) is connected upstream of the throughflow regulator (34) in the flow direction.

9. The fixture according to claim 1, further comprising an annular seal (33) for axial sealing between the fixture and an annular step located in the water outlet (7).

10. A sanitary fixture (1, 2, 4, 5, 6, 7), having an upstream end and a downstream end, the sanitary fixture (1, 2, 4, 5, 6, 7) comprising a mounting housing (9) having a thread (10) which is matingly engagable with a thread (11) provided on a water outlet (70) of a sanitary outlet fitting (8), wherein the mounting housing (9) has a downstream housing end side (12) with flow-through holes (13), and wherein at least one insertion part can be inserted into the mounting housing (9) as far as an insertion stop, the fixture (1, 2, 4, 5, 6, 7) comprises: an aerated jet regulator which is configured such that a circumferential wall of the mounting housing (9) comprises at least one aeration duct (14), which is arranged within the housing and opens out in at least one aeration opening (15) leading into a housing interior of the mounting housing (9); and a throughflow regulator (34) which is connected to and upstream of a jet regulator (16) wherein the jet regulator (16) comprises a diffuser (23) and a diffuser ring (26), and wherein the throughflow regulator (34) has an outermost periphery which is secured within an outer periphery of the diffuser (23).

11. The fixture according to claim 10, wherein an outermost periphery of the diffuser (23) is secured to an outer periphery of the diffuser ring (26).

12. The fixture according to claim 10, wherein the diffuser ring (26) can be inserted into the mounting housing (9) as far as the insertion stop (31), and wherein the diffuser (23), can be inserted into the diffuser ring (26) as far as an insertion stop (32) of the diffuser ring (26).

13. The fixture according to claim 10, wherein the thread (10) provided on the mounting housing (9) is an external thread which is arranged on an outer circumference of the housing (9) and interacts with an internal thread (11) which is located on an inner circumference of the water outlet (70) provided in the form of a mating thread (11).

14. The fixture according to claim 10, wherein the downstream housing end side (12) comprises tool engagement surfaces for a rotation tool which can matingly engage with the tool engagement surfaces.

15. The fixture according to claim 10, wherein the diffuser (23) is configured as a jet splitter and divides a stream of water into a multiplicity of individual jets, and the at least one aeration opening (15) opens out in a housing interior section following the jet splitter in a direction of flow.

16. The fixture according to claim 15, wherein the jet splitter has a multiplicity of flow-through openings (22, 41) for dividing the stream of water into the multiplicity of individual jets.

17. The fixture according to claim 10, further comprising an ancillary sieve (38) is connected upstream of the throughflow regulator (34) in the flow direction.

18. The fixture according to claim 10, further comprising an annular seal (33) for axial sealing between the fixture and an annular step located in the water outlet (7).

* * * * *